US006050337A

United States Patent [19]

Melegari

[11] Patent Number: 6,050,337

[45] Date of Patent: Apr. 18, 2000

[54] EQUIPMENT AND METHOD FOR THE INJECTION OF HIGH-PRESSURE MATERIALS INTO THE SOIL

[76] Inventor: Cesare Melegari, Viale Piacenza 67, Parma (IT), Italy

[21] Appl. No.: 09/041,117

[22] Filed: Mar. 11, 1998

[30] Foreign Application Priority Data

Sep. 12, 1997 [IT] Italy ..... PC97A0024

[51] Int. Cl.[7] ..... E21B 33/13

[52] U.S. Cl. ..... 166/290; 166/289; 166/177.4

[58] Field of Search ..... 166/279, 281, 166/289, 290, 305.1, 308, 177.4, 177.5

[56] References Cited

U.S. PATENT DOCUMENTS 4,084,648 4/1978 Yahiro et al. ..... 175/67
5,006,017 4/1991 Yoshida et al. ..... 405/263

*Primary Examiner*—William Neuder
*Assistant Examiner*—Zakiya Walker
*Attorney, Agent, or Firm*—Young & Thompson

[57] ABSTRACT

The invention relates to an improved equipment for the injection of materials into the subsoil, for consolidation, reclamation etc. A perforating rod is made of two coaxial pipes and equipped, at its end, with three or more radial nozzles. The first one provides the injection of high-pressure fluid that breaks the soil, the second one is devised for the injection of material like a cement-mix, and the third one a injects high-pressure fluid, which mixes the injected material and distributes it into the soil. The invention also relates to a method providing:

the injection of a high-pressure fluid by means of a drilling rod while this rotates and it is simoultaneously risen;

the injection—through a second nozzle downstream the first one—of the material which is to be injected into the soil;

the injection through a third nozzle of a high-pressure fluid.

5 Claims, 2 Drawing Sheets

EQUIPMENT AND METHOD FOR THE INJECTION OF HIGH-PRESSURE MATERIALS INTO THE SOIL

Figure 1:
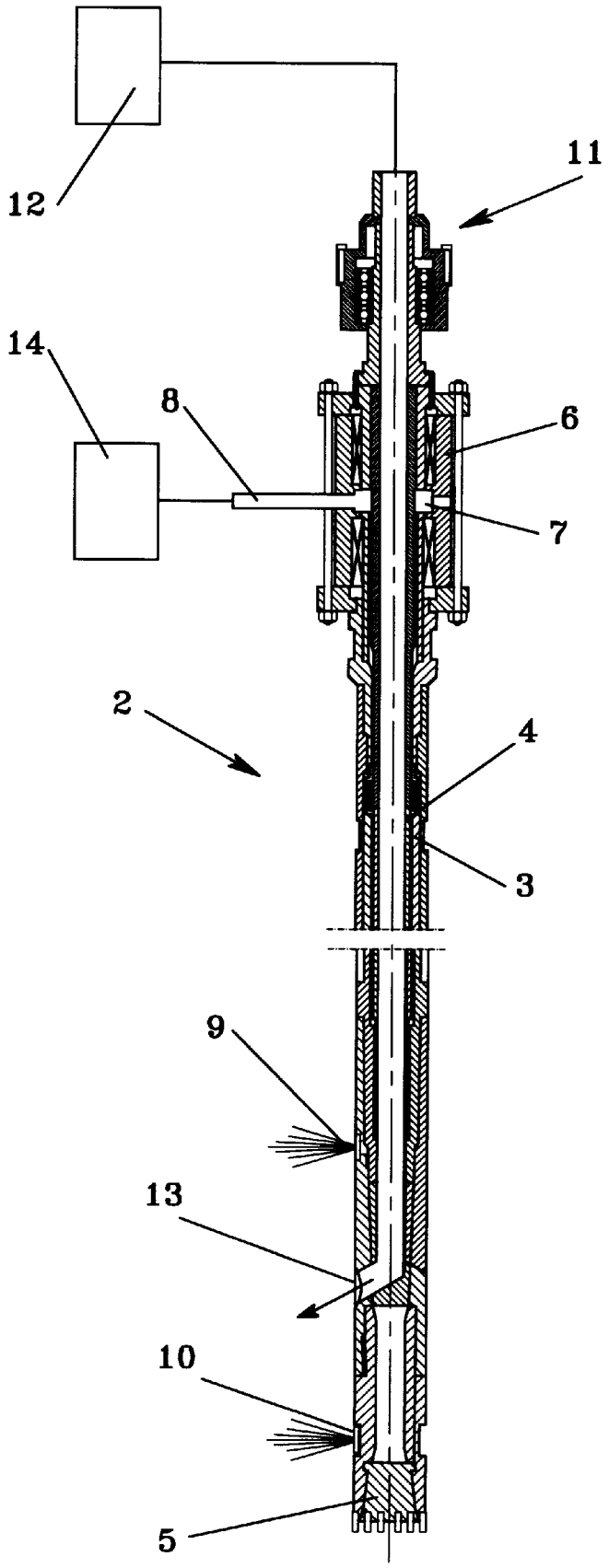

The present invention proposes an improved equipment, and the relevant method for the injection of materials into the subsoil, for consolidation, reclamation etc.

In particular this invention comprises a perforating rod made of two coaxial pipes and equipped, at its end, with three or more radial nozzles. The first one provides the injection of high-pressure fluid that breaks the soil, the second one is devised for the injection of material like a cement-mix, and the third one a injects high-pressure fluid, which mixes the injected material and distributes it into the soil.

This method provides for:

- the injection of a high-pressure fluid by means of a drilling rod while this rotates and it is simultaneously risen;
- the injection—through a second nozzle downstream the first one, of the material which is to be injected into the soil;
- the injection through a third nozzle of a high-pressure fluid.

The two external nozzles which provide the high-pressure fluid are preferably connected to the interspace between the two pipes constituting the perforating rod, while the material to be dispersed into the soil is injected into the soil through the central pipe.

Several techniques are known for interventions into the subsoil, for example for the consolidation and reclamation of the ground and in particular, in latest years, a technique called "jet-grouting method" has developed. This technique is used to obtain columns of consolidated ground and provides for high-pressure injection of the material, through one or more radial nozzles of a perforating rod. This material is dispersed into the soil around the hole to obtain a column of stabilised ground.

Generally the equipment used for this kind of intervention comprises a perforating rod made of a pipe inserted into the soil to the required depth and that is risen while rotating simultaneously. At the same time the material required to consolidate the ground is injected.

The publication WO 9011412 describes a method for making columns of consolidated ground with a reinforced frame. According to said method a hole is drilled into the soil by means of a drilling rod, inserting into the hole a pipe for the injection of liquid cement.

The rod is then risen and the pipe is left into the ground; a frame is placed into the pipe and the high-pressure cement is injected through the pipe into the hole, while rising the pipe from the ground.

U.S. Pat. No. 5,624,209, of the same applicant, describes a method for the injection of materials into the subsoil, used both for reclamation and consolidation of the ground. It involves a perforating rod constituted by two coaxial pipes and having a pair of radial nozzles, also coaxial, in proximity of the bit.

The inner nozzle is fed through the central pipe with a high-pressure fluid, while the external nozzle is fed, through the space between the two pipes, with a low-pressure fluid into which the material to be injected is dispersed. The high-pressure fluid, exiting the central nozzle at a very high speed, breaks the surrounding ground and drags along the low-pressure fluid with aggregates or the material to be mixed to the soil.

These techniques have several advantages, as they allow interventions into the soil at the required depth, and do not need any open cast mining or digging, therefore safeguarding the environment.

The real effectiveness of these methods, depends on the quality of the ground, on the composition of the layers of the subsoil, their hardness etc. It is also known that the column must be as uniform as possible to obtain a column of consolidated ground.

This result is difficult to obtain because of the different conditions of the environment and in particular of the ground.

Several experiments and tests made by the applicant proved that, improving the mixing rate of the injected material with the ground, a more homogeneous column with particular characteristics in stability and resistance is obtained.

Therefore the known techniques can be further improved, and the aim of the present invention is to provide an equipment and method to achieve this aim, providing at the same time a more homogeneous and uniform dispersion of the injected material into the layers, that must be reclaimed or consolidated.

For this purpose, according to the invention a perforating rod is used, made of two coaxial pipes and having at its end, at least three radial nozzles. The external ones are used to inject a high-pressure fluid and the central one, preferably connected to the central pipe, is used to inject the material to be mixed with the ground.

In this way the upper nozzle breaks the ground, the one in the middle injects the material and the lower one mixes the injected material with the ground broken by the first nozzle.

The advantages offered by this method can be obtained without any further costs, since the required equipment can now be obtained simply by modifying any existing equipment.

Figure 2:
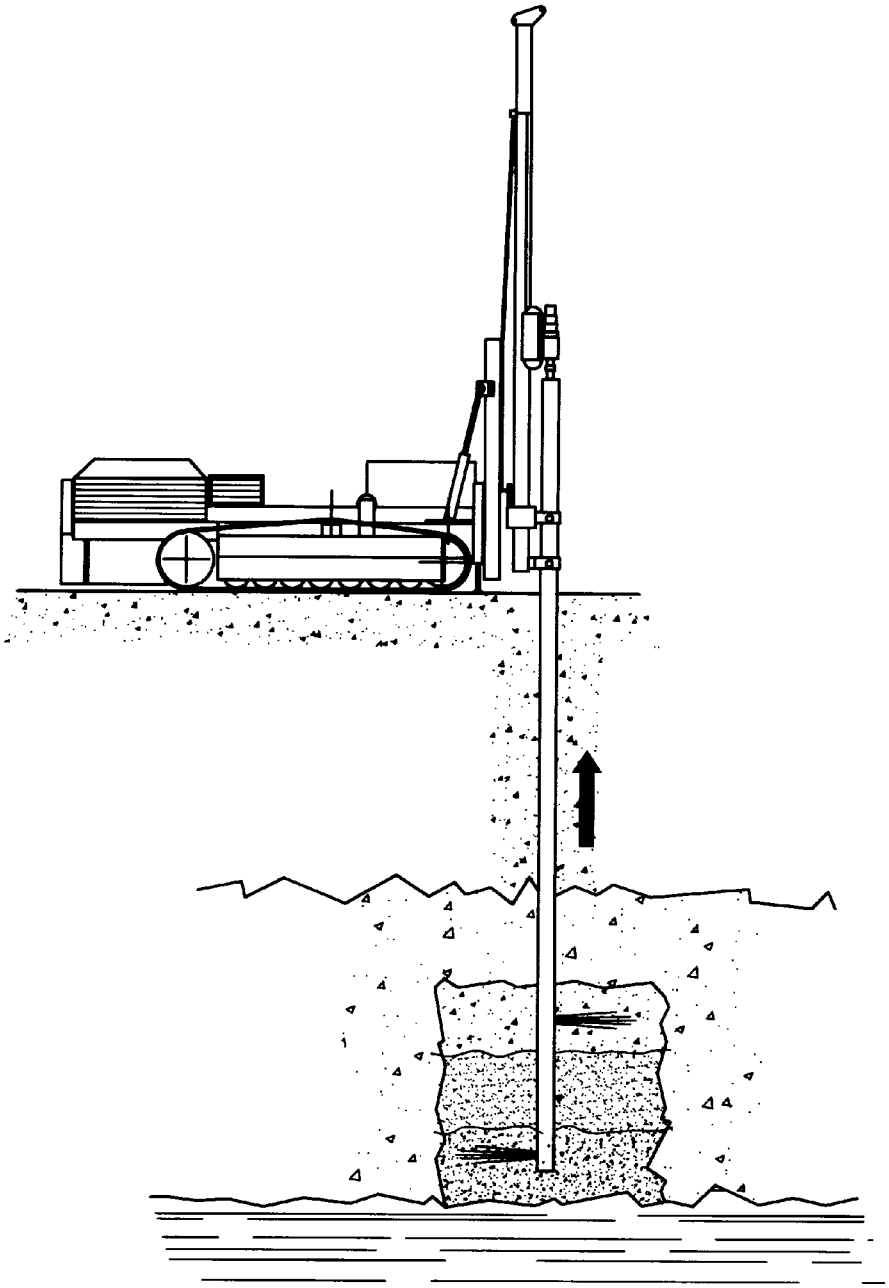

The present invention will now be described in detail, as a non limitative example, and reference can be made to the annexed drawings:

FIG. 1 schematically shows, in a cross view, a perforating rod that is part of the equipment according to the invention;

FIG. 2 schematically shows a phase of the process according to the invention;

The equipment according to the invention comprises a perforating unit indicated as a whole with number 1 in FIG. 2, that can be of a known type. This unit is provided with a perforating rod 2 best shown in FIG. 1.

The rod 2 is made of a pair of coaxial pipes, an external pipe 3 and an internal pipe 4, provided at its lower end with a rock drill 5.

In proximity of the upper end of the rod there is a jacket 6 with an annular chamber 7 through which a pump 14 injects high-pressure material—600 bars and more—coming from a pipe 8 and that flows into the space between the pipes 3 and 4.

Close to the bit, in the wall of the rod, two radial nozzles are obtained; they are at a certain distance one to the other and are indicated respectively at 9 and 10.

The inner pipe 4 is connected, at its upper head 11, with a pump 12 that injects along the pipe the material to be injected into the soil.

This material exits from a third nozzle 13, provided in the lateral wall between the nozzles 9 and 10.

The material directed into the subsoil along the pipe 4 can be consolidating material as concrete mixing with metal insertions, glass fibre or the like, or it can be material used to reclaim soils as oxidant material or reducing material etc.

This material, usually dispersed in a fluid carrier, is preferably fed along the central pipe since this central pipe has a quite large diameter and also the nozzle 13 can be wide enough to let this low-pressure material pass to the outside.

It is clear that the high-pressure fluid can be simply water, and can be injected through the central pipe while the low-pressure material can be directed to the bottom along the space between the pipes.

The nozzles themselves could be more than two, for example two or more pairs of nozzles could be provided, above and below the low-pressure nozzle 13 respectively.

To perform an intervention in the subsoil, a hole is drilled to the required depth, using rod 2 and drill 5. Thereafter a high pressure fluid is injected through nozzles 9 and 10 while rotating the rod and, at the same time, the material to be mixed with the soil is injected through the nozzle 13.

This operation is performed while raising slowly the rod.

In this way the water or the high-pressure fluid exiting the nozzle 9 at a 300–350 m/s speed, breaks the soil surrounding the bar and allows the mix or the cement injected from nozzle 13 to spread around.

The consolidating material is pumped into the soil and is dispersed around the perforating rod as the perforating rod rises. The high-pressure fluid coming out from the lower nozzle 10 completes this mixing action and the column obtained is perfectly uniform.

I claim:

1. Improved equipment for injection of materials into subsoil, comprising a perforating rod made of at least two coaxial pipes respectively connected with an equipment for injecting a high pressure fluid and an equipment for injecting a low pressure material, wherein said rod has at least three radial nozzles comprising two end nozzles with a central nozzle between them, said nozzles being spaced apart lengthwise of the rod the end nozzles being connected to the high-pressure fluid pipe and the central nozzle being linked to the low-pressure material pipe.

2. Improved equipment according to claim 1, wherein said perforating rod comprises two coaxial inner and outer pipes.

3. Improved equipment according to claim 2, wherein said inner pipe is connected to said equipment that injects the material to be dispersed into the soil and said outer pipe is connected to said equipment that injects the high pressure fluid; the central nozzle being fed through the inner pipe and the end nozzles being fed through the outer pipe.

4. Method for injection of material into subsoil, comprising:

drilling a hole into soil to a required depth;

first radially injecting a high pressure fluid into the soil;

then injecting at a low pressure the material that must be dispersed into the soil; and thereafter continuing to inject the high pressure fluid to mix said material with the soil previously broken by said first high pressure fluid.

5. Method according to claim 4, in which the hole is drilled using a drilling rod made of two coaxial pipes and provided with at least three radial nozzles comprising two end nozzles with a central nozzle between them, said nozzles being spaced apart lengthwise of the rod, wherein the high pressure fluid is injected through said two end nozzles and the material to be dispersed into the soil is injected through said central nozzle provided between said two end nozzles, while rotating and raising the rod from the soil.

* * * * *